US006107012A

United States Patent [19]

Fitterman et al.

[11] Patent Number: 6,107,012

[45] Date of Patent: Aug. 22, 2000

[54] TWO-STAGE PROCESSING OF LOW SILVER BLACK-AND-WHITE PHOTOGRAPHIC ELEMENTS

[75] Inventors: Alan S. Fitterman, Rochester; Robert E. Dickerson, Hamlin, both of N.Y.

[73] Assignee: Eastman Kodak Company, Rochester, N.Y.

[21] Appl. No.: 09/426,975

[22] Filed: Oct. 26, 1999

Related U.S. Application Data

[62] Division of application No. 09/313,952, May 18, 1999, Pat. No. 6,040,121.

[51] Int. Cl.[7] ..... G03C 5/305; G03C 5/38

[52] U.S. Cl. ..... 430/464; 430/455

[58] Field of Search ..... 430/464, 465, 430/466, 455, 458

[56] References Cited

U.S. PATENT DOCUMENTS

| | | | |
|---|---|---|---|
| 5,702,875 | 12/1997 | Opitz | 430/492 |
| 5,766,830 | 6/1998 | Shimizu et al. | 430/440 |
| 5,780,209 | 7/1998 | Yamashita et al. | 430/399 |
| 5,800,976 | 9/1998 | Dickerson et al. | 430/567 |
| 5,846,687 | 12/1998 | Deprez et al. | 430/250 |
| 5,871,890 | 2/1999 | Fitterman et al. | 430/419 |
| 5,908,737 | 6/1999 | Fitterman et al. | 430/419 |
| 5,942,378 | 8/1999 | Fitterman et al. | 430/419 |

*Primary Examiner*—Hoa Van Le

*Attorney, Agent, or Firm*—J. Lanny Tucker

[57] ABSTRACT

Low silver black-and-white photographic elements, such as radiographic films, can be processed quickly using a two-stage process in which black-and-white development is carried out in the first stage for up to 30 seconds, and such development continues along with fixing in the second stage for up to 60 seconds when a fixing composition is added. Both stages are carried out in the same processing container.

15 Claims, No Drawings

TWO-STAGE PROCESSING OF LOW SILVER BLACK-AND-WHITE PHOTOGRAPHIC ELEMENTS

CROSS-REFERENCE TO RELATED APPLICATION

This is a Divisional of application Ser. No. 09/313,952 filed May 18, 1999, now U.S. Pat. No. 6,040,121.

FIELD OF THE INVENTION

This invention relates in general to photography and in particular to improved processing of black-and-white photographic silver halide elements. More particularly, it relates to a method of processing low silver radiographic films using two-stage development and development/fixing steps, and to a processing kit useful therein.

BACKGROUND OF THE INVENTION

Roentgen discovered X-radiation by the inadvertent exposure of a silver halide photographic element. In 1913, Eastman Kodak Company introduced its first product specifically intended to be exposed by X-radiation (X-rays). Silver halide radiographic films account for the overwhelming majority of medical diagnostic images. It was recognized almost immediately that the high energy ionizing X-rays are potentially harmful and ways were sought to avoid high levels of patient exposure. Radiographic films provide viewable silver images upon imagewise exposure followed by rapid access processing.

One approach, still in wide-spread use is to coat the silver halide emulsions useful in radiographic films on both sides of the film support. Thus, the number of X-rays that can be absorbed and used for imaging are doubled, providing higher sensitivity. Dual-coated radiographic films are sold by Eastman Kodak Company under the trademark DUPLITIZED films. Films that rely entirely on X-radiation absorption for image capture are referred to in the art as "direct" radiographic elements, while those that rely on intensifying screen light emission are referred to as "indirect" radiographic elements.

There are other applications for direct radiographic films, such as in various industrial applications where X-rays are captured in imaging, but intensifying screens cannot be used for some reason (such as for pipeline and turbine blade welds).

It is the prevailing practice to process radiographic films using black-and-white development, fixing, washing and drying. Films processed in this manner are then ready for image viewing.

Photographic black-and-white developing compositions containing a silver halide black-and-white developing agent are well known in the photographic art for reducing silver halide grains containing a latent image to yield a developed photographic image. Many useful developing agents are known in the art, with hydroquinone and similar dihydroxybenzene compounds and ascorbic acid (and derivatives) being some of the most common. Such compositions generally contain other components such as sulfites, buffers, antifoggants, halides and hardeners.

Fixing compositions for radiographic films are also well known and include one or more fixing agents, of which thiosulfates are most common. Such compositions generally include sulfites as antioxidants.

U.S. Pat. No. 5,800,976 (Dickerson et al) describes radiographic elements having lower silver coverage and including certain covering power enhancing compounds within the silver halide emulsions. Such elements are generally processed in conventional developing compositions that include hydroquinone or other dihydroxybenzene compounds. However, such developing compositions are not desirable because of their negative impact on the environment. "Monobath" solutions are also known in the art of photographic processing. These solutions typically require long processing times and contain components common to both developing and fixing compositions, that is a high pH and sulfite. It has been difficult to achieve acceptable processing with monobath solutions because either fixing occurred too quickly (thus $D_{max}$ is too low) or little fixing occurred because of fogging (high $D_{min}$) or there was too little fixing agent or insufficient fixing time. The desired balance of all conditions and sensitometric results is difficult to achieve. Either very long processing time is needed, or the density is too low from removal of too much silver. These concerns are increased when the radiographic elements to be processed contain silver coverage that is lower than normal.

Various two-stage processing methods have been carried out using roomlight handleable radiographic elements such as those described in U.S. Pat. No. 5,871,890 (Fitterman et al). While those methods are useful in the specific contexts described in the noted applications, there is no appreciation that two-stage processing could be used effectively with radiographic element containing reduced silver coverage.

The industry needs a two-stage processing method that overcomes the noted problems and can provide acceptable black-and-white images in a short time in an environmentally acceptable manner.

SUMMARY OF THE INVENTION

The noted problems are overcome with a method for providing a black-and-white image comprising:

A) in a processing container, developing an imagewise exposed black-and-white photographic silver halide element using a black-and-white developing composition that has a pH of from about 9 to about 12 and is free of ammonium ions, and comprises:

from about 100 to about 300 mmol/l of a black-and-white developing agent, and from about 200 to about 500 mmol/l of sulfite ions, and B) within up to 30 seconds of the beginning of step A, introducing into the processing container, a fixing composition that is free of ammonium ions and has a pH of from about 4 to about 6, and comprises from about 500 to about 1500 mmol/l of a photographic fixing agent other than a sulfite, and continuing processing for up to an additional 60 seconds, wherein prior to step A, the black-and-white photographic silver halide element comprises a support having disposed on each side thereof, a silver halide emulsion unit that comprises silver halide grains and a gelatino-vehicle, the silver halide grains comprising at least 95 mol % bromide based on total silver, at least 50% of the silver halide grain projected area being provided by tabular grains having an average aspect ratio greater than 8, a thickness no greater than 0.10 $\mu$m, and an average grain diameter of from about 1.5 to about 3 $\mu$m, the coverage of silver in each silver halide emulsion unit being no more than 11 mg/dm$^2$, and the coverage of the gelatino-vehicle in each silver halide emulsion unit being no more than 11 mg/dm$^2$.

This invention also provides a processing kit comprising:

a) a black-and-white developing composition that has a pH of from about 9 to about 12 and is free of ammonium ions, and comprises:

from about 100 to about 300 mmol/l of a black-and-white developing agent, and from about 200 to about 300 mmol/l of sulfite ions, and b) one or more of the following components:

a fixing composition that is free of ammonium ions and has a pH of from about 4 to about 6, and comprises a photographic fixing agent other than a sulfite, a processing container, and a black-and-white photographic silver halide element comprising a support having disposed on each side thereof, a silver halide emulsion unit that comprises silver halide grains and a gelatino-vehicle, the silver halide grains comprising at least 95 mol % bromide based on total silver, at least 50% of the silver halide grain projected area being provided by tabular grains having an average aspect ratio greater than 8, a thickness no greater than 0.10 $\mu$m, and an average grain diameter of from about 1.5 to about 3 $\mu$m, the coverage of silver in each silver halide emulsion unit being no more than 11 mg/dm$^2$, and the coverage of the gelatino-vehicle in each silver halide emulsion unit being no more than 11 mg/dm$^2$.

The present invention provides for single tank or single use processing of black-and-white photographic silver halide elements in an environmentally acceptable manner. Such elements would find considerable advantage for various applications including dental and industrial uses.

The elements are processed using a two-stage development process in a single processing container whereby solely black-and-white development is carried out in the first stage for up to 30 seconds. Upon addition of a suitable photographic fixing agent (other than a sulfite) to the developing composition, development is continued simultaneously with fixing in the second stage for up to an additional 60 seconds. Thus, both stages are carried out in the same processing container, providing a simplified process, and avoiding the need for separate development and fixing in separate baths or containers.

This two-stage process has been shown to be a practical alternative to the use of monobath solutions to provide relatively quick processing of low silver radiographic elements with relatively weaker or more dilute developing compositions. By allowing development to be initiated in the first stage prior to fixing, desired sensitometric results can be obtained. As used in this application, "monobath" is meant to describe a processing composition having both photographic black-and-white developing and fixing properties.

Because ammonium ions are avoided, the processing compositions used in the invention present less impact when discharged into the environment. In preferred embodiments, ascorbic acid or a derivative thereof is used as a black-and-white developing agent in place of the more common dihydroxybenzene or its derivatives. This makes the developing composition even more environmentally suitable.

Processing can be accomplished in a relatively rapid fashion because of the combination of the low silver photographic element and processing compositions. The element has lower silver and binder coverage than normal, allowing for the processing solution to diffuse quickly into the element, cause desired chemical reactions, and remove unwanted silver.

DETAILED DESCRIPTION OF THE INVENTION

The present invention is useful for providing a black-and-white image in a photographic silver halide element, and preferably a low silver radiographic film. Other types of elements that can be processed using the present invention include, but are not limited to, aerial films, black-and-white motion picture films, duplicating and copy films, and amateur and professional continuous tone black-and-white films that have lower silver halide coverage. The general composition of such materials is well known in the art but specific features that render them particularly adaptable to the present invention are described below in more detail.

The black-and-white developing composition of this invention contains one or more black-and-white developing agents, including dihydroxybenzene and derivatives thereof, and ascorbic acid and derivatives thereof.

Dihydroxybenzene and similar developing agents include hydroquinone and other derivatives readily apparent to those skilled in the art (see for example, U.S. Pat. No. 4,269,929 of Nothnagle and U.S. Pat. No. 5,457,011 of Lehr et al). Hydroquinone is the preferred dihydroxybenzene developing agent.

The preferred developing agents are what are known as "ascorbic acid" developing agents, meaning ascorbic acid and derivatives thereof. Ascorbic acid developing agents are described in a considerable number of publications in photographic processes, including U.S. Pat. No. 5,236,816 (Purol et al) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, y-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. No. 5,089,819 and U.S. Pat. No. 5,278,035 (both of Knapp), U.S. Pat. No. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure,* publication 37152, March 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The black-and-white developing composition can also include one or more auxiliary co-developing agents that are also well known (for example, Mason, *Photographic Processing Chemistry,* Focal Press, London, 1975). Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl-4,4-dihydroxymethyl-3-pyrazolidone. Other useful auxiliary co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in U.S. Pat. No. 5,837,434 (Roussihle et al). A most preferred auxiliary co-developing agent is 4-hydroxymethyl-4-methyl-1-phenyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol.

A mixture of different types of auxiliary developing agents can also be used if desired.

An organic antifoggant is also preferably present in the black-and-white developing composition, either singly or in admixture. Such compounds control the gross fog appearance in the processed elements. Suitable antifoggants include, but are not limited to, benzimidazoles, benzotriazoles, mercaptotetrazoles, indazoles and mercaptothiadiazoles. Representative antifoggants include 5-nitroindazole, 5-p-nitrobenzoylaminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole. Benzotriazole is most preferred.

The developing composition also includes one or more preservatives or antioxidants. Various conventional black-and-white preservatives can be used including sulfites. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known buffers, such as borates, carbonates and phosphates, can be included in the compositions to maintain the desired pH. The pH can be adjusted with a suitable base (such as a hydroxide) or acid. The pH of the developing composition is generally from about 9 to about 12, and more preferably from about 10 to about 11.

Optionally, the black-and-white developing composition contains one or more sequestering agents that typically function to form stable complexes with free metal ions (such as silver ions) in solution, in conventional amounts. Many useful sequestering agents are known in the art, but particularly useful classes of compounds include, but are not limited to, multimeric carboxylic acids as described in U.S. Pat. No. 5,389,502 (Fitterman et al), aminopolycarboxylic acids, polyphosphate ligands, ketocarboxylic acids, and alkanolamines. Representative sequestering agents include ethylenediamine-tetraacetic acid, diethylenetriaminepentaacetic acid, 1,3-propylenediamine-tetraacetic acid, 1,3-diamino-2-propanoltetraacetic acid, ethylenediamino-disuccinic acid and ethylenediaminomonosuccinic acid.

The black-and-white developing composition can contain other additives including various development restrainers, development accelerators, swelling control agents and stabilizing agents, each in conventional amounts. Examples of such optional components are described in U.S. Pat. No. 5,236,816 (noted above), U.S. Pat. No. 5,474,879 (Fitterman et al), Japanese Kokai 7-56286 and EP-A-0 585 792.

The black-and-white developing composition is essentially free of ammonium ions meaning that no ammonium ions are purposely added and any ammonium ions present are there only as contaminants or are leached out of the processed elements. Thus, salts used in the composition are generally in the form of sodium or potassium salts.

In the second stage of the process, a fixing composition containing a photographic fixing agent is added to the black-and-white developing composition to form a combined developing/fixing composition. While sulfite ion sometimes acts as a fixing agent, the fixing agents used in the second stage are not sulfites. Rather, the useful photographic fixing agents are chosen from thiosulfates (including sodium thiosulfate, ammonium thiosulfate, potassium thiosulfate and others readily known in the art), cysteine (and similar thiol containing compounds), mercapto-substituted compounds (such as those described by Haist, *Modern Photographic Processing,* John Wiley & Sons, N.Y., 1979), thiocyanates (such as sodium thiocyanate, potassium thiocyanate, ammonium thiocyanate and others readily known in the art), amines and halides. Mixtures of one or more of these classes of fixing agents can be used if desired. Thiosulfates and thiocyanates are preferred. In a some embodiments, a mixture of a thiocyanate (such as sodium thiocyanate) and a thiosulfate (such as sodium thiosulfate) is used. In such mixtures, the molar ratio of a thiosulfate to a thiocyanate is from about 1:1 to about 1:10, and preferably from about 1:1 to about 1:2. The sodium salts of the fixing agents are preferred for environmental advantages. Thus, the fixing composition is also free of ammonium ions, similar to the black-and-white developing composition.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 4, preferably at least 4.5, and generally less than 6, and preferably less than 5.5.

This combined developing/fixing composition then also contains one or more black-and-white developing agents (preferably an ascorbic acid), sulfites, one or more non-sulfite photographic fixing agents, and preferably in addition, one or more auxiliary co-developing agents, one or more sequestering agents, and one or more antifoggants, as described above. The combined composition is also free of ammonium ions.

The essential (and some optional) components described above are present in the aqueous developing and fixing compositions in the general and preferred amounts listed in Table I, all minimum and maximum amounts being approximate (that is, "about"). If formulated in dry form, the compositions would have the essential components in amounts readily apparent to one skilled in the art suitable to provide the desired liquid concentrations.

TABLE I

| | General Amount | Preferred Amount |
|---|---|---|
| Developing Composition | | |
| Developing agent | 100 to 300 mmol/l | 110 to 225 mmol/l |
| Auxiliary Co-developing agent | 5 to 15 mmol/l | 7 to 10 mmol/l |
| Antifoggant | 0 to 2.5 mmol/l | 1 to 1.5 mmol/l |
| Sulfite ions | 200 to 500 mmol/l | 200 to 250 mmol/l |
| Bromide ions | 0 to 30 mmol/l | 20 to 25 mmol/l |
| Buffer, e.g. carbonate | 250 to 800 mmol/l | 400 to 600 mmol/l |
| Fixing Composition | | |
| Fixing agent other than sulfite | 500 to 1500 mmol/l | 600 to 1350 mmol/l |
| Sulfite antioxidant | 45 to 180 mmol/l | 60 to 120 mmol/l |
| Buffer, e.g. acetate | 50 to 250 mmol/l | 90 to 200 mmol/l |

The developing and fixing compositions useful in the practice of this invention are prepared by dissolving or dispersing the components in water and adjusting the pH to the desired value. The compositions can also be provided in concentrated form, and diluted to working strength just before use, or during use. The components of the compositions can also be provided in a kit of two or more parts to be combined and diluted with water to the desired strength and placed in the processing equipment. The compositions can be used as their own replenishers, or another similar solutions can be used as the replenishers. After the first stage of black-and-white development, the fixing composition is added to the black-and-white developing composition already in the processing container, in either dry or aqueous form.

Processing can be carried out in any suitable processor or processing container for a given type of photographic element. For example, for radiographic films, the method can be carried out using one or more containers or vessels for carrying out both stages of development and development/fixing.

In most instances, the processed element is a film sheet, but it can also be a continuous element. Each element is bathed in the processing compositions for a suitable period of time in each stage.

Development and fixing are preferably, but not essentially, followed by a suitable washing step to remove silver salts dissolved by fixing and excess fixing agents, and to reduce swelling in the element. The wash solution can be water, but preferably the wash solution is acidic, and more preferably, the pH is 7 or less, and preferably from about 4.5 to about 7, as provided by a suitable chemical acid or buffer.

After washing, the processed elements may be dried for suitable times and temperatures, but in some instances the black-and-white images may be viewed in a wet condition.

Processing times and conditions for the invention are listed in the following Table II with the minimum and maximum values being approximate (that is, "about"). The total time for the two stages of the method of this invention is generally at least 30, and preferably at least 45 seconds, and generally less than 90 and preferably less than 60 seconds.

TABLE II

| PROCESSING STEP | TEMPERATURE (° C.) | TIME (sec) |
|---|---|---|
| Development (first stage) | 15–30 | 5–30 |
| Development/fixing (second stage) | 15–30 | 25–60 |
| Washing | 15–30 | 15–60 |

The black-and-white photographic silver halide elements processed using the present invention are generally composed of a conventional flexible, transparent film support (polyester, cellulose acetate or polycarbonate) that has applied to each side one or more photographic silver halide emulsion layers. For radiographic films, it is conventional to use blue-tinted support materials to contribute to the blue-black image tone sought in fully processed films. Polyethylene terephthalate and polyethylene naphthalate are preferred film supports.

In general, such elements, emulsions, and layer compositions are described in many publications, including *Research Disclosure,* publication 36544, September 1994. *Research Disclosure* is a publication of Kenneth Mason Publications, Ltd., Dudley House, 12 North Street, Emsworth, Hampshire PO10 7DQ England.

The emulsion layers contain a light-sensitive high silver bromide relied upon for image formation. To facilitate rapid access processing the grains preferably contain less than 2 mol % (mole percent) iodide, based on total silver. The silver halide grains are predominantly silver bromide in content. Thus, the grains can be composed of silver bromide, silver iodobromide, silver chlorobromide, silver iodochlorobromide, silver chloroiodobromide or silver iodochlorobromide as long as bromide is present in an amount of at least 95 mol % (preferably at least 98 mol %) based on total silver content.

In addition to the advantages obtained by composition selection described above it is specifically contemplated to employ silver halide grains that exhibit a coefficient of variation (COV) of grain ECD of less than 20% and, preferably, less than 10%. It is preferred to employ a grain population that is as highly monodisperse as can be conveniently realized.

In addition, at least 50% (and preferably at least 70%) of the silver halide grain projected area is provided by tabular grains having an average aspect ratio greater than 8, and preferably greater than 12. The average thickness of the grains is generally at least 0.06 and no more than 0.10 $\mu$m, and preferably at least 0.07 and no more than 0.09 $\mu$m. The average grain diameter is from about 1.5 to about 3 $\mu$m, and preferably from about 1.8 to about 2.4 $\mu$m.

Tabular grain emulsions that satisfy high bromide grain requirements and gelatino-vehicle requirements, except that the gelatino-vehicle is fully forehardened, are described in greater detail in the following patents, the disclosures of which are here incorporated by reference:

| | |
|---|---|
| Dickerson | US-A-4,414,310, |
| Abbott et al | US-A-4,425,425, |
| Abbott et al | US-A-4,425,426, |
| Kofron et al | US-A-4,439,520, |
| Wilgus et al | US-A-4,434,226, |
| Maskasky | US-A-4,435,501, |

-continued

| | |
|---|---|
| Maskasky | US-A-4,713,320, |
| Dickerson et al | US-A-4,803,150, |
| Dickerson et al | US-A-4,900,355, |
| Dickerson et al | US-A-4,994,355, |
| Dickerson et al | US-A-4,997,750, |
| Brunch et al | US-A-5,021,327, |
| Tsaur et al | US-A-5,147,771, |
| Tsaur et al | US-A-5,147,772, |
| Tsaur et al | US-A-5,147,773, |
| Tsaur et al | US-A-5,171,659, |
| Dickerson et al | US-A-5,252,442, |
| Dickerson | US-A-5,391,469, |
| Dickerson et al | US-A-5,399,470, |
| Maskasky | US-A-5,411,853, |
| Maskasky | US-A-5,418,125, |
| Daubendiek et al | US-A-5,494,789, |
| Olm et al | US-A-5,503,970, |
| Wen et al | US-A-5,536,632, |
| King et al | US-A-5,518,872, |
| Fenton et al | US-A-5,567,580, |
| Daubendiek et al | US-A-5,573,902, |
| Dickerson | US-A-5,576,156, |
| Daubendiek et al | US-A-5,576,168, |
| Olm et al | US-A-5,576,171, and |
| Deaton et al | US-A-5,582,965. |

The patents to Abbott et al Fenton et al, Dickerson and Dickerson et al are cited and incorporated by reference to show conventional element features in addition to the gelatino-vehicle, high bromide tabular grain emulsions and other critical features of the present invention.

Film contrast can be raised by the incorporation of one or more contrast enhancing dopants. Rhodium, cadmium, lead and bismuth are all well known to increase contrast by restraining toe development. The toxicity of cadmium has precluded its continued use. Rhodium is most commonly employed to increase contrast and is specifically preferred. Contrast enhancing concentrations are known to range from as low $10^{-9}$ mole/Ag mole. Rhodium concentrations up to $5\times10^{-3}$ mole/Ag mole are specifically contemplated. A specifically preferred rhodium doping level is from $1\times10^{-6}$ to $1\times10^{-4}$ mole/Ag mole.

A variety of other dopants are known, individually and in combination, to improve contrast as well as other common properties, such as speed and reciprocity characteristics. Dopants capable providing "shallow electron trapping" sites, commonly referred to as SET dopants, are specifically contemplated. SET dopants are described in *Research Disclosure,* Vol. 367, November 1994, Item 36736. Iridium dopants are very commonly employed to decrease reciprocity failure. A summary of conventional dopants to improve speed, reciprocity and other imaging characteristics is provided by *Research Disclosure,* Item 36544, cited above, Section I. Emulsion grains and their preparation, sub-section D. Grain modifying conditions and adjustments, paragraphs (3), (4) and (5).

Low COV emulsions can be selected from among those prepared by conventional batch double-jet precipitation techniques. A general summary of silver halide emulsions and their preparation is provided by *Research Disclosure,* Item 36544, cited above, Section I. Emulsion grains and their preparation. After precipitation and before chemical sensitization the emulsions can be washed by any convenient conventional technique using techniques disclosed by *Research Disclosure,* Item 36544, cited above, Section III. Emulsion washing.

The emulsions can be chemically sensitized by any convenient conventional technique as illustrated by *Research Disclosure,* Item 36544, Section IV. Chemical sensitization. Sulfur and gold sensitizations are specifically contemplated.

Both silver bromide and silver iodide have significant native sensitivity within the blue portion of the visible spectrum. Hence, when the emulsion grains contain high (>50 mol %, based on total silver) bromide concentrations, spectral sensitization of the grains is not essential, though still preferred. It is specifically contemplated that one or more spectral sensitizing dyes will be absorbed to the surfaces of the grains to impart or increase their light-sensitivity. Ideally the maximum absorption of the spectral sensitizing dye is matched (e.g., within ±10 nm) to the principal emission band or bands of the fluorescent intensifying screen. In practice any spectral sensitizing dye can be employed which, as coated, exhibits a half peak absorption bandwidth that overlaps the principal spectral region(s) of emission by a fluorescent intensifying screen intended to be used with the first radiographic film.

A wide variety of conventional spectral sensitizing dyes are known having absorption maxima extending throughout the near ultraviolet (300 to 400 nm), visible (400 to 700 nm) and near infrared (700 to 1000 nm) regions of the spectrum. Specific illustrations of conventional spectral sensitizing dyes is provided by *Research Disclosure,* Item 18431, Section X. Spectral Sensitization, and Item 36544, Section V. Spectral sensitization and desensitization, A. Sensitizing dyes.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

It is also preferred that the silver halide emulsions include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (noted above) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

It is still again preferred that the silver halide emulsion on each side of the support includes dextran or polyacrylamide as water-soluble polymers that can also enhance covering power. These polymers are generally present in an amount of at least 0.1:1 weight ratio to the gelatino-vehicle (described below), and preferably in an amount of from about 0.3:1 to about 0.5:1 weight ratio to the gelatino-vehicle. The dextran or polyacrylamide can be present in an amount of up to 5 $mg/dm^2$, and preferably at from about 2 to about a 4 $mg/dm^2$. The amount of covering power enhancing compounds on the two sides of the support can be the same or different.

The silver halide emulsion and other layers forming the imaging units on opposite sides of the support of the radiographic element contain conventional hydrophilic colloid vehicles (peptizers and binders) that are typically gelatin or a gelatin derivative (identified herein as "gelatino-vehicles"). Conventional gelatino-vehicles and related layer features are disclosed in *Research Disclosure,* Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin).

To allow maximum density requirements to be satisfied with minimal silver coating coverage it is necessary to limit the forehardening of the gelatino-vehicle. Whereas it has become the typical practice to fully foreharden radiographic elements containing tabular grain emulsions, the radiographic elements of this invention are only partially forehardened. Thus, the amount of hardener in each silver halide emulsion unit is generally at least 0.1% and less than 0.8%, and preferably at least 0.3% and less than 0.6%, based on the total dry weight of the gelatino-vehicle.

Conventional hardeners can be used for this purpose, including formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydro-quinoline, N-carbarnoyl pyridinium salts, carbamoyl oxypyridinium salts, bis(imoniomethyl) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed finction such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

In each silver halide emulsion unit in the radiographic element, the level of silver is generally at least 8 and no more than 11 mg/dm$^2$, and preferably at least 9 and no more than 10 mg/dm$^2$. In addition, the coverage of gelatino-vehicle is generally at least 6 and no more than 11 mg/dm$^2$, and preferably at least 7.5 and no more than 9.5 mg/dm$^2$. The amounts of silver and gelatino-vehicle on the two sides of the support can be the same or different.

The radiographic elements generally include a surface overcoat on each side of the support that are typically provided for physical protection of the emulsion layers. In addition to vehicle features discussed above the overcoats can contain various addenda to modify the physical properties of the overcoats. Such addenda are illustrated by *Research Disclosure,* Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Advantageously, the processing method of this invention can be carried out using a processing kit that includes some or all of the components necessary for the method. Minimally, the processing kit would include the black-and-white developing composition, and one or more of the other components, such as the fixing composition, processing container, black-and-white photographic silver halide element (one or more samples thereof), instructions for use, washing solution, fluid or composition metering devices, or any other conventional components of a photographic processing kit. All of the components can be suitably packaged in dry or liquid form in glass or plastic bottles, fluid-impermeable packets or vials.

The following example is provided for illustrative purposes, and is not to be considered limiting in any manner.

Materials and Methods for Examples

A radiographic film (Element A) within the scope of the present invention was prepared having the following layer arrangement and composition on each side of a poly (ethylene terephthalate) support:

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 μm) | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Emulsion Formulation | |
| T-grain emulsion (AgBr 2.0 × 0.07 μm) | 10.6 |
| Gelatin | 7.5 |
| 4-hydroxy-6-methyl-1,3,3a,7-tetraazaindene | 2.1 g/Ag mole |
| 4-hydroxy-6-methyl-2-methylmercapto-1,3,3a, 7-tetraazaindene | 400 mg/Ag mole |
| 2-mercapto-1,3-benzothiazole | 30 mg/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Dextran P | 2.5 |
| Polyacrylamide | 2.69 |
| Carboxymethyl casein | 1.61 |
| Bisvinylsulfonylmethlyether | 0.4% based on total gelatin in all layers |

A Control radiographic element (Element B) was also evaluated using the compositions and methods of this invention. This element is commercially available as KODAK T-MAT G radiographic film.

The black-and white developing and fixing compositions of the following Table III were used in the Example. The pH values were adjusted in the compositions by addition of potassium carbonate or acetic acid, but any other suitable base or acid can be used for this purpose. In a Control process, commercially available RP X-OMAT RA/30 Developer ("RA/30") was used as the black-and-white developing composition.

TABLE III

| COMPONENT | Developing Composition I (mmol/l) | Developing Composition II (mmol/l) | Fixing Composition I (mmol/l) | Fixing Composition II (mmol/l) | Fixing Composition III (mmol/l) | Fixing Composition IV (mmol/l) |
|---|---|---|---|---|---|---|
| Ascorbic acid | 132 | 149 | 0 | 0 | 0 | 0 |
| Benzotriazole | 1.1 | 1.25 | 0 | 0 | 0 | 0 |
| 4-Hydroxymethyl-4-methyl-1-phenyl-3-pyrazolidone | 8.2 | 9.2 | 0 | 0 | 0 | 0 |
| Potassium sulfite | 208 | 238 | 0 | 0 | 0 | 0 |
| Potassium bromide | 22.7 | 25.2 | 0 | 0 | 0 | 0 |
| Potassium carbonate | 500 | 550 | 0 | 0 | 0 | 0 |
| Sodium thiosulfate | 0 | 0 | 1210 | 1164 | 1340 | 670 |
| Sodium sulfite | 0 | 0 | 108 | 104 | 120 | 60 |
| Sodium acetate | 0 | 0 | 170 | 162 | 190 | 95 |
| Acetic acid | 0 | 0 | 56.6 | 53 | 61.6 | 30 |
| pH | 10–11 | 10–11 | 4.5–5.5 | 4.5–5.5 | 4.5–5.5 | 4.5–5.5 |

EXAMPLE

This example was used to determine the performance of various black-and white developer and fixing compositions in the practice the invention.

Samples of the radiographic elements A and B described above were exposed to 500 Lux fluorescent lighting for 60 seconds, then processed using the various developing and fixing compositions at room temperature as shown in TABLE IV below. The various sensitometric results (fog and speed) have conventional meanings, were measured using conventional procedures, and are also shown in TABLE IV.

TABLE IV

| Element | Developing Composition | Fixing Composition | Two-stages Processing Time (sec/sec) | Fog | Speed |
|---|---|---|---|---|---|
| B | I | II | 20/20 | 0.30 | 411 |
| B | I | II | 15/15 | 0.48 | 378 |
| B | II | III | 15/15 | 0.41 | 391 |
| B | II | III | 10/20 | 0.30 | 420 |
| B | RA/30 | III | 5/20 | 0.27 | 422 |
| A | I | II | 20/20 | 0.18 | 413 |
| A | I | II | 15/15 | 0.18 | 408 |
| A | II | III | 15/15 | 0.22 | 441 |
| A | II | III | 10/20 | 0.22 | 432 |
| A | RA/30 | III | 5/20 | 0.21 | 433 |

These results show that incomplete fixing occurred during the processing of Element B (high fog). In contrast, processing of Element A provided acceptable sensitometric results (consistently lower fog, higher speed and contrast) using the black-and-white developing and fixing compositions and two-stage process of this invention. Complete fixing of Element A was less time dependent than for Element B.

The invention has been described in detail with particular reference to preferred embodiments thereof, but it will be understood that variations and modifications can be effected within the spirit and scope of the invention.

What is claimed is:

1. A processing kit comprising:

a) a black-and-white developing composition that has a pH of from about 9 to about 12 and is free of ammonium ions, and comprises:

from about 100 to about 300 mmol/l of a black-and-white developing agent, and from about 200 to about 300 mmol/I of sulfite ions, and b) each of the following components:

a fixing composition that is free of ammonium ions and has a pH of from about 4 to about 6, and comprises a photographic fixing agent other than a sulfite, a processing container, and a black-and-white photographic silver halide element comprising a support having disposed on each side thereof, a silver halide emulsion unit that comprises silver halide grains and a gelatino-vehicle, said silver halide grains comprising at least 95 mol % bromide based on total silver, at least 50% of the silver halide grain projected area being provided by tabular grains having an average aspect ratio greater than 8, a thickness no greater than 0.10 $\mu$m, and an average grain diameter of from about 1.5 to about 3 $\mu$m, the coverage of silver in each silver halide emulsion unit being no more than 11 mg/dm$^2$, and the coverage of the gelatino-vehicle in each silver halide emulsion unit being no more than 11 mg/dm$^2$.

2. The processing kit of claim 1 wherein said black-and-white developing composition comprises said black-and-white agent at a concentration of from about 110 to about 225 mmol/l, said sulfite ions at a concentration of from about 200 to about 250 mmol/l, and said fixing composition comprises said photographic fixing agent other than a sulfite at a concentration of from about 600 to about 1350 mmol/l, and sulfite ions at a concentration of from about 45 to about 180 mmol/l.

3. The processing kit of claim 1 wherein each silver halide emulsion unit comprises from about 0.1 to about 0.8% hardener based on the total dry weight of said gelatino-vehicle, the coverage of silver in each silver halide emulsion unit is from about 9 to about 10 mg/dm$^2$, the coverage of said gelatino-vehicle in each silver halide emulsion unit is from about 7.5 to about 9.5 mg/dm$^2$, at least 70% of the silver halide grain projected area being provided by tabular grains having a thickness of from about 0.07 to about 0.09 $\mu$m, and an average grain diameter of from about 1.8 to about 2.4 $\mu$m, and each of said silver halide emulsion units comprises a polyacrylamide or dextran in a weight ratio to said gelatino-vehicle of at least 0.1:1.

4. The processing kit of claim 1 wherein said black-and-white developing composition has a pH of from about 10 to about 11, and said fixing composition has a pH of from about 4.5 to about 5.5.

5. The processing kit of claim 1 wherein said black-and-white developing composition further comprises an auxiliary co-developing agent or an antifoggant.

6. The processing kit of claim 5 wherein said auxiliary co-developing agent is present at a concentration of from about 5 to about 15 mmol/l, or said antioxidant is present at a concentration of up to 2.5 mmol/l.

7. The processing kit of claim 5 wherein said black-and-white developing composition comprises said black-and-white agent at a concentration of from about 110 to about 225 mmol/l, said sulfite ions at a concentration of from about 200 to about 250 mmol/l, and said fixing composition comprises said photographic fixing agent other than a sulfite at a concentration of from about 600 to about 1350 mmol/l.

8. The processing kit of claim 7 wherein said fixing composition comprises sulfite ions at a concentration of from about 45 to about 180 mmol/l.

9. The processing kit of claim 1 wherein said fixing photographic agent is cysteine, a thiosulfate, a thiocyanate, or any combination of these.

10. The processing kit of claim 1 wherein said developing composition is free of dihydroxybenzene developing agents and comprises an ascorbic acid developing agent, potassium or sodium sulfite, a phenidone auxiliary co-developing agent and an antifoggant.

11. The processing kit of claim 1 wherein each silver halide emulsion unit comprises from about 0.1 to about 0.8% hardener based on the total dry weight of said gelatino-vehicle.

12. The processing kit of claim 11 wherein the coverage of silver in each silver halide emulsion unit is from about 9 to about 10 mg/dm$^2$, and the coverage of said gelatino-vehicle in each silver halide emulsion unit is from about 7.5 to about 9.5 mg/dm$^2$.

13. The processing kit of claim 1 wherein at least 70% of the silver halide grain projected area being provided by tabular grains of said silver halide element have a thickness of from about 0.07 to about 0.09 $\mu$m and an average grain diameter of from about 1.8 to about 2.4 $\mu$m.

14. The processing kit of claim 1 wherein each of said silver halide emulsion units comprises a polyacrylamide or dextran in a weight ratio to said gelatino-vehicle of at least 0.1:1.

15. The processing kit of claim 1 wherein each of said silver halide emulsion units comprises dextran at a coverage of up to 5 mg/dm$^2$.

* * * * *